US005153460A

United States Patent [19]

Bovino et al.

[11] Patent Number: 5,153,460

[45] Date of Patent: Oct. 6, 1992

[54] TRIGGERING TECHNIQUE FOR MULTI-ELECTRODE SPARK GAP SWITCH

[75] Inventors: Lawrence J. Bovino, Eatontown; William H. Wright, Jr., Neptune, both of N.J.

[73] Assignee: The United States of America as represented by the Secretary of the Army, Washington, D.C.

[21] Appl. No.: 673,916

[22] Filed: Mar. 25, 1991

[51] Int. Cl.[5] ..... H01J 17/00

[52] U.S. Cl. ..... 307/108; 307/117

[58] Field of Search ..... 307/106, 108, 117, 112, 307/113; 361/120, 130

[56] References Cited

U.S. PATENT DOCUMENTS

| | | | |
|---|---|---|---|
| 3,811,064 | 5/1974 | Kawiecki | 313/325 |
| 3,845,322 | 10/1974 | Aslin | 307/108 |
| 4,283,747 | 8/1981 | Perkins, Jr. | 361/120 |
| 4,604,554 | 8/1986 | Wootton | 315/330 |

*Primary Examiner*—Jeffrey A. Gaffin

*Attorney, Agent, or Firm*—Michael Zelenka; William H. Anderson

[57] ABSTRACT

A spark gap switch having a mid-plane or triggering electrode is brought into a conductive state using a photoconductive switch or other suitable switch, closed by a laser pulse on other pulsed light source. The photoconductive switch is connected between one of the primary electrodes and the mid-plane electrode and brings the potential of the mid-plane electrode to the same potential as the primary electrode when the photoconductive switch is closed. The use of the photoconductive switch permits shorter closing times and eliminates the need for high voltage auxiliary triggering circuits. Plural photoconductive switches, which are triggered in a precise predetermined sequence, improve the operation of Marx generators and other multi-spark gap switch applications.

16 Claims, 3 Drawing Sheets

FIG. 1 PRIOR ART
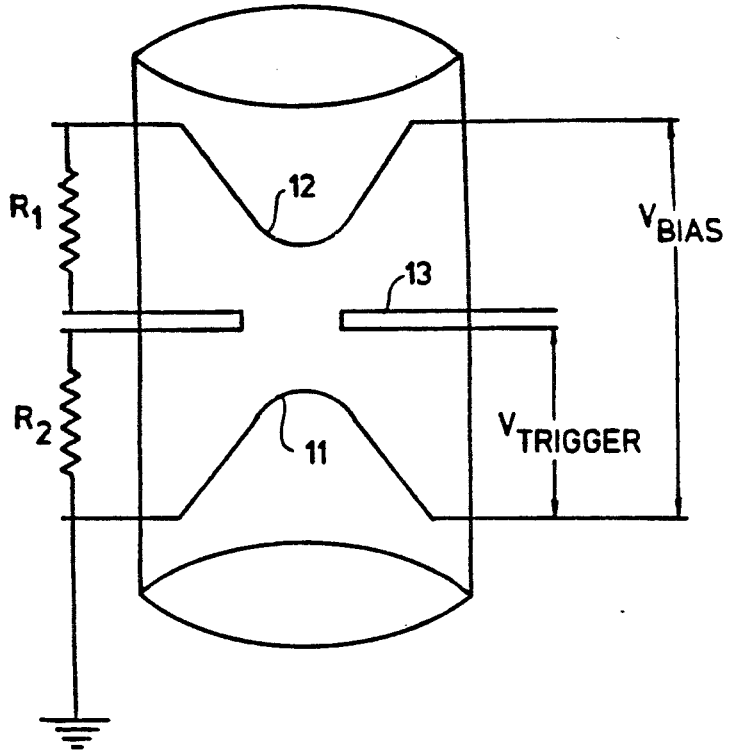
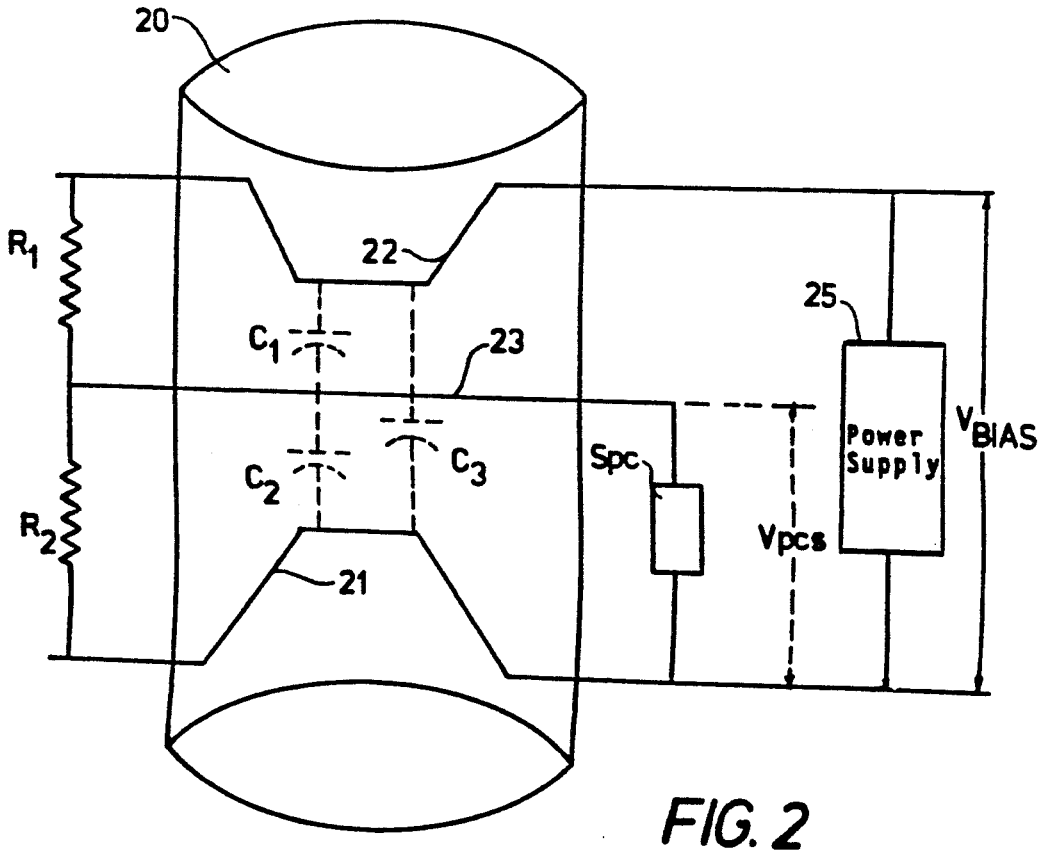
FIG. 2

TRIGGERING TECHNIQUE FOR MULTI-ELECTRODE SPARK GAP SWITCH

TECHNICAL FIELD

The present invention relates generally to high powered pulsers using spark gap switches and more particularly to triggering high pressure (1 atmosphere or greater) gaseous discharge switches.

BACKGROUND ART

The use of spark gap switches for applications requiring very high operating voltages and currents such as pumping pulsed gas discharge lasers, is well known. A conventional spark gap switch includes a pair of electrodes spaced far enough apart such that a voltage applied across them is insufficient to bridge the gap between them until triggered. This type of switch is an excellent insulator for voltages below the hold-off value or breakdown voltage of the gap, providing a high degree of safety.

When current flow is desired across the gap, the gas between the electrodes (usually air) must be sufficiently ionized to cause the gap to break down. This may be accomplished by a sudden increase of voltage across the gap, a sudden reduction in density of gas dielectric between the electrodes, natural radio active irradiation of the gap, ultra violet irradiation of the gap, a heated filament in the gas dielectric around the gap, distortion of the electric field formed in the gap, or injection of ions and/or electrons into the gap. As is well known in the art, all of these methods require substantial and often cumbersome triggering mechanism.

One technique for triggering the breakdown of the gap between electrodes is the use of a mid-plane or triggering electrode placed in the gap between primary electrodes as shown in FIG. 1. The gap between primary electrodes 11, 12 is approximately cut in half by the positioning of mid-plane electrode 13. Typically such a spark gap switch is exposed to high pressure (1 atmosphere or greater) around its electrodes. The hold-off voltage of the switch is determined by the electrode spacing (gap) and the gas pressure between the electrodes. When current flow between the primary electrodes 11, 12 is desired, a trigger voltage (usually a high voltage pulse) is applied, as shown, to the mid-plane electrode 13. The high voltage trigger pulse causes localized ionization between the edges of mid-plane electrode. If the electric field across the primary electrodes is sufficiently high the ionization spreads throughout the gap between the primary electrodes. As a result of the spreading gas ionization, the gap breaks down and current flow between the primary electrodes is initiated. A spark gap switch using a triggering electrode is found in U.S. Pat. No. 4,604,554 issued to Wooten on Aug. 5, 1986 and entitled, "TRIGGERED SPARK GAP DISCHARGER."

Generally, the circuit providing the high voltage trigger pulse to the mid-plane electrode includes a power supply, a pulse transformer, capacitors and other appropriate components. The trigger circuit operates at high voltage and is consequently expensive. The high voltage components of the trigger circuit also introduce a time delay into the operation of the spark gap switch, making rapid triggering and precise timing in systems using such switches problematical.

The problem of imprecise timing becomes more critical in systems using multiple spark gap arrangements such as a Marx generator, which requires simultaneous closing of all its spark gap switches for optimal operation (FIG. 3). Further, each spark gap switch has its own high voltage triggering circuit and power supply. The power supplies, sometimes not effectively isolated from each other, often are required to "float" above ground potential. These conditions can be dangerous as well as further complicating the timing of the spark gap switches.

DISCLOSURE OF THE INVENTION

An object of the invention is to rapidly and precisely initiate current flow in a spark gap switch.

Another object of the invention is to lower the cost of spark gap switch triggering circuits.

A further object is to make spark gap switch triggering circuitry safe.

A further object of the invention is to accurately and efficiently operate a Marx bank or other multiple gap circuits requiring precise switch timing.

According to the present invention, a spark gap switch has a pair of primary electrodes, biased to a predetermined potential, and a mid-plane electrode biased to an intermediate potential. A pull-down means to adjust voltage is connected between one primary electrode and the mid-plane electrode. The pull-down means brings the potential of the mid-plane electrode to be approximately the same as that of the first primary electrode.

Another aspect of the invention is a method for triggering a spark gap having primary electrodes and a mid-plane electrode. The primary electrodes are biased to a predetermined potential and the mid-plane electrode is biased to an intermediate potential. The potential of the mid-plane electrode is adjusted to be approximately equal to that of a first primary electrode. This adjustment initiates current flow between the primary electrodes.

A Marx generator in accordance with the invention comprises: a plurality of capacitors connected in parallel; a plurality of impedances connected between each pair of capacitors; a plurality of spark gap switch means for connecting pairs of the capacitors in series; and an output spark gap switch means for connecting the series of capacitors formed at the spark gap switch means to an external load. Preferably, each of the spark gap switch means and the output spark gap switch means includes a pair of primary electrodes; a mid-plane electrode; and, a switch connected between a first primary electrode and the mid-plane electrode. The switch is used for adjusting potential on the mid-plane electrode to be approximately equal to that on the first primary electrode.

Another object of the invention is to more rapidly trigger current flow in a spark gap switch having a mid-plane electrode and a photoconductive trigger.

A triggering arrangement for a spark gap switch having a pair of primary electrodes, in accordance with a further aspect of the invention comprises a mid-plane electrode and a photoconductive switch. The photoconductive switch is connected between a first primary electrode and the mid-plane electrode. The photoconductive switch has an inherent resistance and inductance, as does the entire triggering arrangement. The primary electrodes and the mid-plane electrode are arranged so that a first set of capacitances exists between the mid-plane electrode and the primary electrodes and a second capacitance exist between the primary electrodes. The primary electrode, mid-plane electrode and photoconductive switch are arranged so that a resonant loop formed by one of the first capacitances and total inductance and-resistance of the triggering arrangement resonates at a predetermined frequency. The predetermined frequency has a time period less than the time period necessary to break down the spark gap switch when the photoconductive switch is closed. As a result, a voltage larger than the bias voltage temporarily exists between a second primary electrode and the mid-plane electrode when said photoconductive switch is closed.

BRIEF DESCRIPTION OF DRAWINGS

FIG. 1 is a circuit diagram of a prior art spark gap switch having a mid-plane electrode.

FIG. 2 is a circuit diagram of a spark gap switch having a mid-plane electrode and using the triggering technique of the present invention.

BEST MODE FOR CARRYING OUT THE INVENTION

Figure 3:
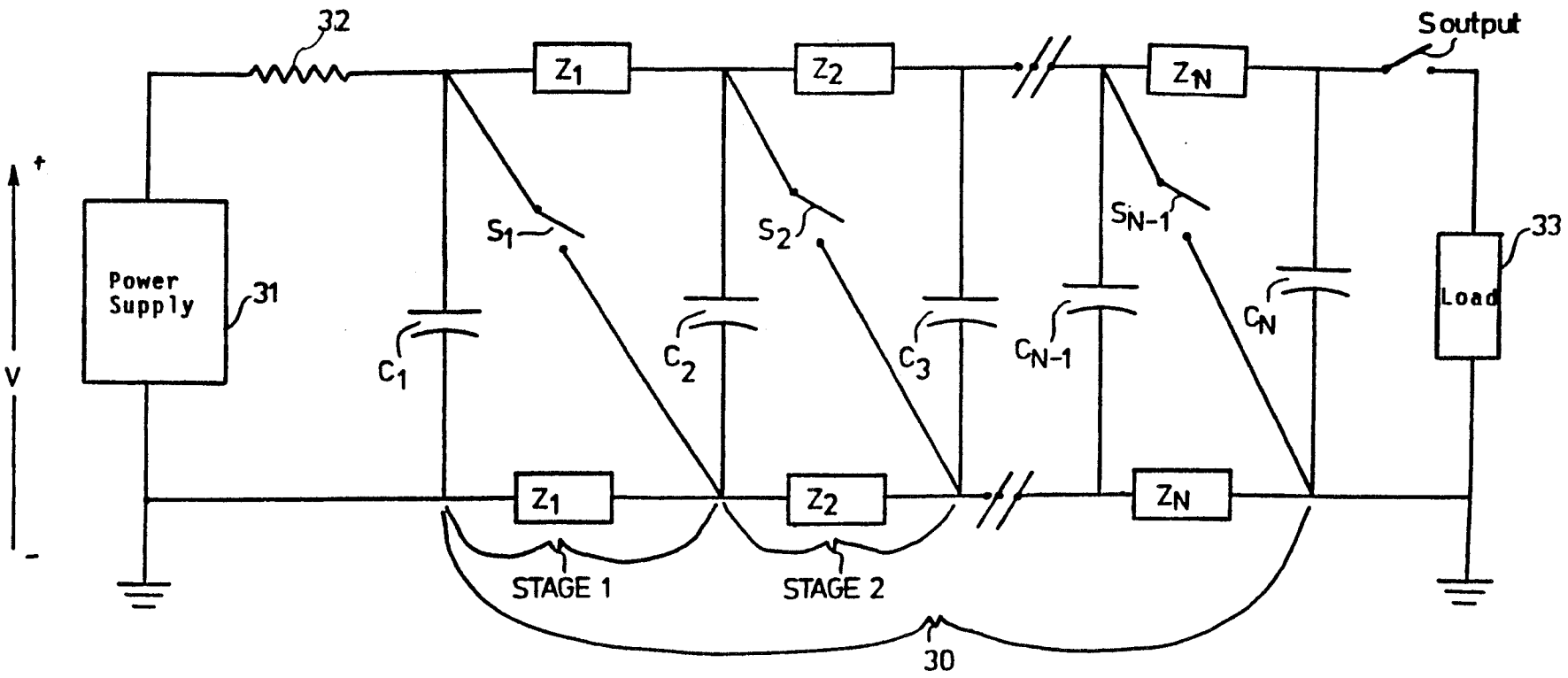
FIG. 3 is a circuit diagram of a "Marx generator", or "Marx bank".

Referring to FIG. 2, a spark gap switch 20 having a mid-plane electrode 23, and primary electrodes 21. 22 is biased by a voltage $V_{bias}$ having a value of between 60% to 90% of the spark gap breakdown voltage. Biasing resistors $R_1$ and $R_2$ are used to balance the mid-plane voltage at a value between 0 volt and $V_{bias}$. A typical value is between 40% and 60% of $V_{bias}$.

Switch $S_{pc}$ is a conventional fast-acting photoconductive switch or other fast operating switch having a resistance which can be rapidly lowered many orders of magnitude when irradiated by a laser pulse or other light source capable of evoking a rapid response by the switch.

Current flow in the spark gap is initiated when a laser pulse or other pulsed light source activates the photoconductive switch $S_{pc}$, causing it to close. Closing the photoconductive switch brings the potential on the mid-plane electrode 23 to approximately that of the primary electrode 21 to which the photoconductive switch is connected. This places the voltage, $V_{bias}$ across the remaining gap between primary electrode 22 and mid-plane electrode 23, causing the remaining gap to break down very rapidly. The relation of capacitors $C_1$–$C_3$ to the present invention are described in more detail with the description of FIG. 4.

As a result of this operation, current flow in the spark gap switch is rapidly initiated without the use of an auxiliary power supply. The triggering circuit uses the potential of the primary electrodes and so can remain isolated from circuitry external to the spark gap switch, reducing the risk of failure due to shorts in auxiliary circuitry. Since the typical high voltage components, such as capacitors, conventional in such switches are eliminated, time delays normal in conventional arrangements are not introduced in the present invention.

In accordance with another aspect of the invention, a plurality of mid-plane electrode spark gap switches each triggered by a photoconductive switch are implemented in a Marx generator. FIG. 3 is a circuit diagram of a typical Marx generator, or Marx bank, 30, a well known arrangement for voltage multiplication used in the field of high power pulser design. The Marx generator 30 is fed by a power supply 31 through a charging resistor 32. The capacitors $C_1$, $C_2$, $C_3$...$C_N$, connected in parallel, each are charged through impedance elements $Z_1$, $Z_2$,...$Z_N$ to the power supply voltage V. The impedance elements generally comprise an inductance and a resistance. The element Z isolate the stages of the Marx generator; value of the impedance element are chosen to provide desired time constants.

When a high voltage pulse is to be generated by the Marx bank, all the spark gap switches are simultaneously closed as quickly as possible. Once the spark gap switches are closed, the capacitances $C_1$, $C_2$,...$C_N$ are connected in series producing an output pulse having a theoretical value N x V. When the output switch $S_{output}$ is closed, the high voltage pulse is delivered to load 33.

To enable a Marx generator to operate efficiently, timing of the spark gaps switches must be accurate The required accuracy can be maintained by the present invention since all the spark gap switches of the Marx generator can be triggered by a pulsed beam from a single light source, allowing for precise synchronization.

Figure 6:
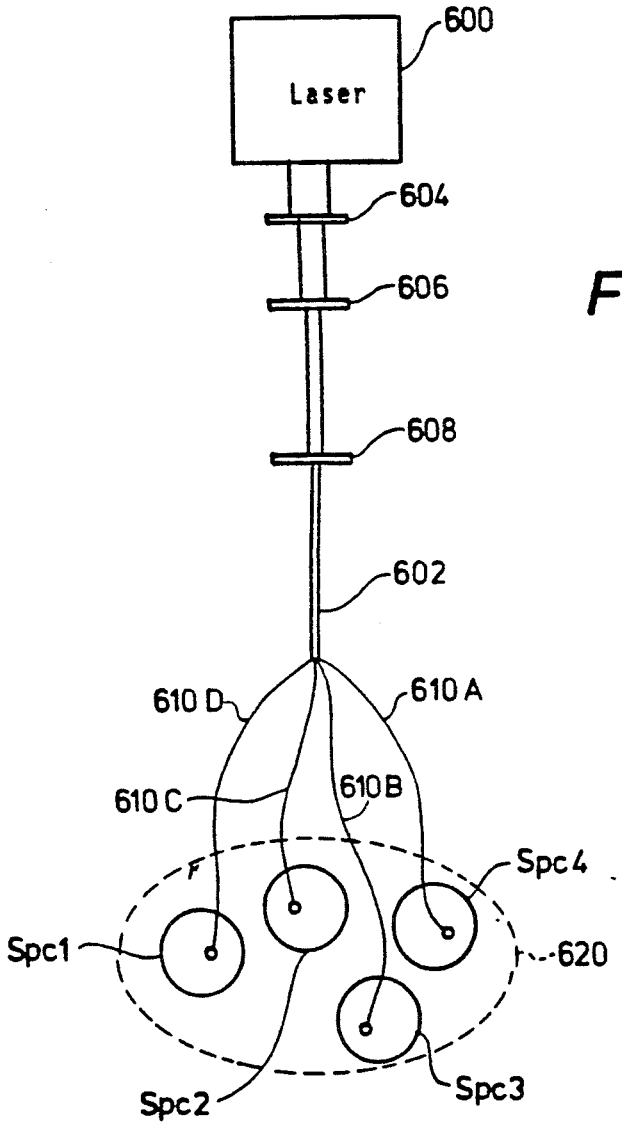
FIG. 6 is a block diagram of an arrangement for triggering a plurality of photoconductive switches simultaneously.

An arrangement for simultaneously triggering the spark gap switches in a Marx gernerator is shown in FIG. 6. Laser 600 emits a pulsed beam which is split by beam splitters 604, 606, 608 into an appropriate number of sub-beams. These are carried by fiber optic bundle 602 to the location 620 of the Marx generator and its spark gap switches. Optic fibers 610–610 D carry individual sub-beams to photoconductive triggering switches $S_{pc1}$–$S_{pc4}$.

Since the spark gap switches are closed more rapidly in the present invention than with conventional triggering techniques, rapid rise of the leading edge of the Marx pulse results. This reduces the time that the high voltage is applied to the output switch $S_{output}$, prolonging switch life. The absence of the auxiliary power supplies necessary for conventional triggering arrangements removes any danger caused by interconnection of high voltage components which are often required to float above ground potential.

Greater speed in initiating spark gap current flow can be achieved by further increasing the voltage in the gap between the mid-plane electrode 23 and primary electrode 22 when the photoconductive switch $S_{pc}$ is closed. This can be done by a resonant or a ringing trigger which can supply a voltage greater than the normal bias voltage $V_{bias}$ across the gap between the mid-plane electrode 23 and primary electrode 22 after the photoconductive switch has been closed.

Figure 4:
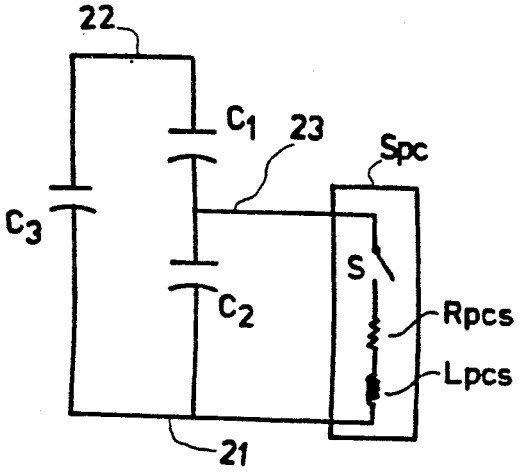
FIG. 4 is a diagram showing equivalent circuit elements found in a biased spark gap switch having a mid-plane electrode, and triggered by a photoconductive switch.

FIG. 4 is a circuit diagram representing equivalent circuit elements found in the spark gap switch 20 and the photoconductive switch $S_{pc}$. Capacitance $C_2$ exists between the mid-plane electrode 23 and the primary electrode 21 to which the photoconductive switch is attached. Capacitance $C_1$ exists between the mid-plane electrode and primary electrode 22. Capacitance $C_3$ exists between the primary electrodes 21, 22 when biased by voltage $V_{bias}$ from external power supply 25. $S_{pc}$ and $L_{pcs}$ represent the resistance and inductance found in the photoconductive switch $S_{pc}$ in a closed state. The connections to the photoconductive switch also have resistance and inductance, and there are further external factors adding to the total resistance and the inductance calculated to exist across the photoconductive switch. Persons skilled in the art can appreciate that the external inductance and resistance can be adjusted as required. These factors can be calculated so that a total inductance and a total resistance across the photoconductive switch can be derived.

The total inductance $L_{total}$ and total resistance $R_{total}$ as well as $C_2$ can form a loop having a resonant frequency. This resonant frequency will have a specific period. The spark gap switch 20 and the photoconductive switch $S_{pc}$ can be designed so that the values of $L_{total}$, $R_{total}$ and $C_2$ determine a resonant frequency having a time period much shorter than the time normally required to break down the spark gap switch when is closed.

Figure 5:
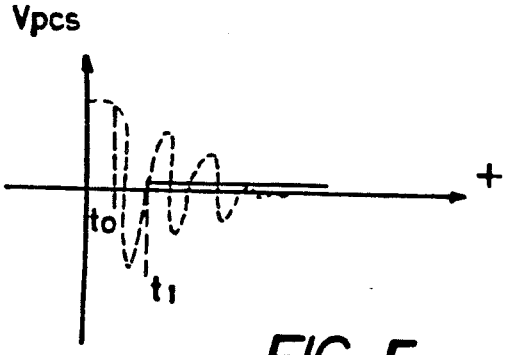
FIG. 5 is a graph of voltage $V_{pcs}$ between the mid-plane electrode and a primary electrode.

Under such conditions, the voltage waveform across the photoconductive switch $V_{pcs}$, shown in FIG. 5 will continue to oscillate through the abscissa due to loop inductance even after the photoconductive switch $S_{pc}$ is closed at time $t_0$. The continuation of the $V_{pcs}$ voltage waveform will cause additional voltage, in excess of the power supply voltage $V_{bias}$ to appear across the upper gap between primary electrode 22 and the mid-plane electrode 23.

Once the spark gap breaks down and conducts completely as shown at $t_1$, $V_{pcs}$ will return to some small positive value. This value represents the conduction loss of the spark gap switch and is shown in FIG. 5 by the solid horizontal line beginning at $t_1$. FIG. 5 also shows a dotted wave form, $V_{pcs}$, depicted as if the gap had failed to break down and the spark gap switch conduct.

The result of this resonant or ringing trigger technique is a faster breakdown time than could otherwise be achieved using a photoconductive switch across the mid-plane electrodes and one primary electrode.

Although a number of the arrangements of the invention have been mentioned by way of example, it is not intended that invention be limited thereto. Accordingly, the invention should be considered to include any and all configurations, modifications, variations, combinations or equivalent arrangements falling within the scope of the following claims.

What is claimed is:

1. A spark gap switch comprising:

a pair of primary electrodes, biased to a predetermined potential;

at least one mid-plane electrode biased at a predetermined intermediate potential; and pull down means connected between one of said primary electrodes and said mid-plane electrode, for adjusting a potential on said mid-plane electrode to be approximately equal to that of one primary electrode.

2. The spark gap switch as in claim 1 wherein said pull down means comprises a photoconductive switch.

3. The spark gap switch as in claim 2 wherein said photoconductive switch is responsive to a pulsed light source.

4. The spark gap switch as in claim 3 wherein said pulsed light source is a laser.

5. The spark gap switches in claim 2, further comprising biasing resistors connected between said mid-plane electrode and each of said primary electrodes.

6. A method for triggering a spark gap switch having first and second primary electrodes and at least one mid-plane electrode, the method comprising the steps of:

biasing said primary electrodes to a predetermined potential;

biasing said mid-plane electrode to a predetermined intermediate potential; and adjusting said predetermined intermediate potential on said mid-plane electrode to be approximately equal to a potential on a first primary electrode, whereby current flows between said primary electrodes.

7. The method of claim 6 wherein said predetermined potential is approximately 60% to 90% of breakdown voltage of said primary electrodes.

8. The method of claim 7 wherein said intermediate potential is between 40% and 60% of said predetermined potential.

9. A Marx generator comprising:

a plurality of capacitors connected in parallel;

a plurality of impedances connected between each pair of said capacitors;

a plurality of spark gap switch means for connecting pairs of said capacitors in series;

an output spark gap switch means for connecting a series of said capacitors to an external load;

each said spark gap switch means and output spark gap switch means comprising a pair of primary electrodes, at least one mid-plane electrode, and a switch connected between a first primary electrode and a first mid-plane electrode, for adjusting a potential on said mid-plane electrode to be approximately equal to that on said first primary electrode.

10. The Marx generator of claim 9 wherein said plurality of spark gap switch means and said output spark gap switch means are arranged to be simultaneously activated responsive to a single light pulse.

11. The Marx generator of claim 10 wherein said single light pulse is generated by a laser.

12. The Marx generator of claim 9 wherein said plurality of spark gap switch means and said output spark gap switch means are arranged to be activated in a predetermined sequence so as to generate a predetermined waveform.

13. A triggering arrangement for a spark gap switch having a pair of primary electrodes, at least one trigger electrode and at least one photoconductive switch connected between a first primary electrode and said trigger electrode, said photoconductive switch having an inherent composite resistance and inductance;

said primary electrodes and said mid-plane electrode arranged so that a first set of capacitances exists between said trigger electrode and said primary electrodes and a second capacitance exists between said primary electrodes, a resonant loop being formed by one of said first capacitances, said total inductance and said total resistance of said triggering arrangement resonates at a predetermined frequency;

said predetermined frequency having a time period less than a time period necessary to break down said spark gap switch when said photoconductive switch is closed, wherein a voltage larger than said bias voltage temporarily exists between a second primary electrode and said trigger electrode when said photoconductive switch is closed.

14. The triggering arrangement of claim 13 wherein said photoconductive switch is closed by a pulsed light source.

15. The triggering arrangement of claim 14 wherein said pulsed light source is a laser.

16. The triggering arrangement of claim 13 wherein said trigger electrode is a mid-plane electrode.

* * * * *